United States Patent [19]

Paige

[11] 4,289,268

[45] Sep. 15, 1981

[54] FOLDABLE CARTON

[75] Inventor: Richard E. Paige, New York, N.Y.

[73] Assignee: The Paige Company Containers, Inc., New York, N.Y.

[21] Appl. No.: 119,617

[22] Filed: Feb. 8, 1980

[51] Int. Cl.[3] ..... B65D 5/08; B65D 5/36

[52] U.S. Cl. ..... 229/41 B; 229/39 R

[58] Field of Search ..... 229/41 B, 39 R

[56] References Cited

U.S. PATENT DOCUMENTS

| | | | |
|---|---|---|---|
| 2,327,709 | 8/1943 | Himes | 229/41 B X |
| 2,348,378 | 5/1944 | Goodyear | 229/41 B UX |
| 3,927,824 | 12/1975 | Razziano | 229/41 B X |
| 4,007,869 | 2/1977 | Stolkin et al. | 229/41 B |
| 4,187,976 | 2/1980 | Mather | 229/41 B |

*Primary Examiner*—Davis T. Moorhead

*Attorney, Agent, or Firm*—Alan H. Levine

[57] ABSTRACT

A foldable carton having side walls and end walls hingedly connected together along their side edges, and a bottom panel hingedly connected to the lower edge of each wall. The bottom panels of two adjacent side and end walls are hingedly connected together and the bottom panels of the other two adjacent side and end walls are also hingedly connected together. The bottom panels move from a location between the side and end walls, when the carton is collapsed, to a location perpendicular to the side and end walls when the carton is erected. One of the bottom panels is larger than the others, and overlies and is supported by the other bottom panels when the carton is in erect condition. The larger panel has a hinge line along which it bends during its movement when the carton is folded and unfolded between its collapsed and erect conditions. The hinge line of the larger panel extends at an acute angle to the hinge between the larger bottom panel and its respective carton wall.

9 Claims, 11 Drawing Figures

FOLDABLE CARTON

This invention relates to foldable cartons of the type usually formed of corrugated cardboard, and particularly to such cartons foldable and unfoldable between a flattened or collapsed condition and an open or erect condition. More specifically, the invention relates to foldable cartons wherein bottom panels of the carton are permanently hinged together in such a way that they automatically form the carton bottom, when the side and end walls of the carton are pulled apart to erect the carton, without any separate manual manipulation of the bottom panels.

U.S. Pat. No. 2,327,709 shows a foldable carton having hinged-together bottom panels for automatically forming the carton bottom when the carton is erected. The carton of this patent is made of relatively thin, and hence flexible, paperboard. Where a carton is needed to hold heavy material, such a paper records to be stored, which may weigh 40 to 60 pounds, the paperboard is not strong enough for the task; hence, a sturdier material such as corrugated cardboard must be used.

As the carton of U.S. Pat. No. 2,327,709 is folded and unfolded between its collapsed and erect conditions, the permanently hinged-together bottom panels must flex to permit movement of those panels from their position between and parallel to the flattened carton walls, when the carton is collapsed, to their bottom-forming position perpendicular to the carton walls, when the carton is erect. Consequently, if a carton of this type were formed of more rigid corrugated cardboard, the inability of the board to bend would make it impossible to open the carton, if originally formed in collapsed condition, or impossible to collapse the carton, if originally formed in erect condition.

Other problems presented by the carton of U.S. Pat. No. 2,327,709 involve the fact that in the erect condition of the carton, the four bottom panels interengage each other in an overlapping manner at the center of the carton bottom. As a result, the carton bottom is not smooth, but rather has a stepped configuration at various locations around the carton bottom. Furthermore, the carton bottom is inherently weak where the bottom panels overlap but are not permanently secured to each other. Both the non-planar formation of the bottom, and its inherent weakness, are serious problems when the carton is used to store paper records and similar materials which are heavy and have a certain fluidity.

It is an object of the present invention to provide a foldable carton formed of relatively stiff corrugated cardboard, having permanently hinged-together bottom panels which automatically form the carton bottom when the carton is unfolded into erect condition, wherein the bottom panels do not prevent folding and unfolding of the carton.

It is another object of the invention to provide such a carton which, when in erect condition, has a smooth continuous bottom unencumbered by points of weakness.

It is a further object of the invention to provide such a carton wherein one of the bottom panels, used to form the carton bottom when the carton is erect, may be of a size equal to the dimensions of the carton bottom, so as to produce a smooth, one-piece carton floor, the carton nevertheless having the ability to set up and collapse with ease.

Additional objects and features of the invention will be apparent from the following description in which reference is made to the accompanying drawings.

Figure 6:
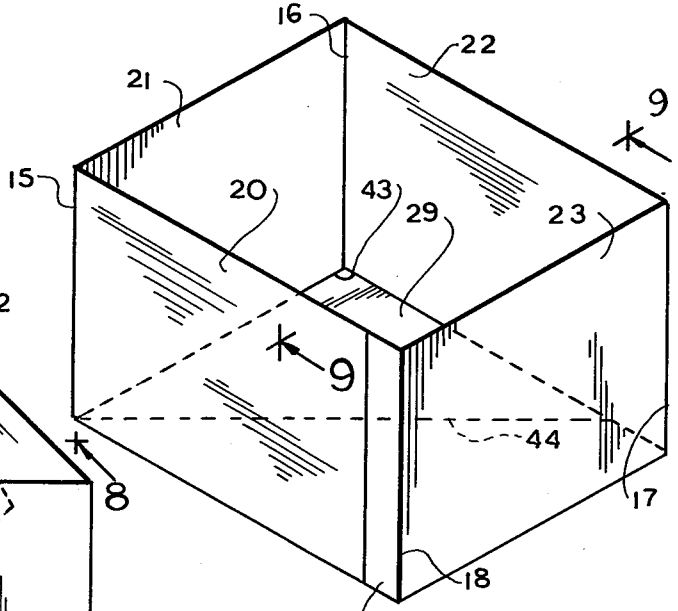
Figure 5:
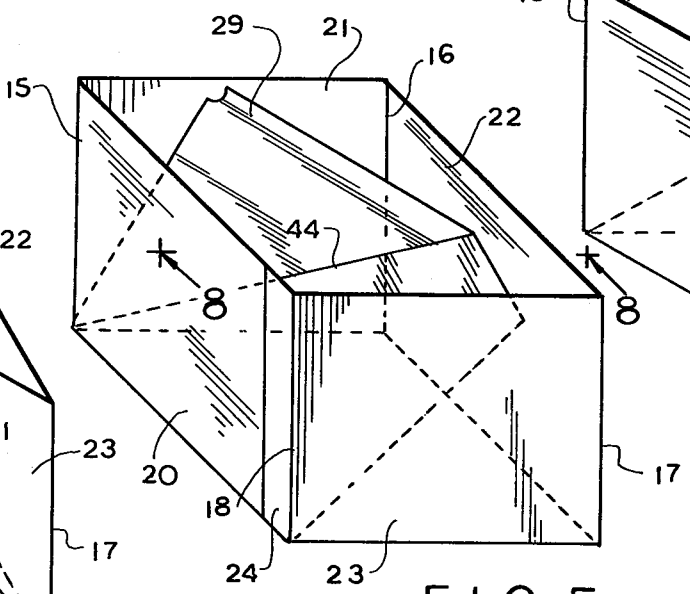
Figure 4:
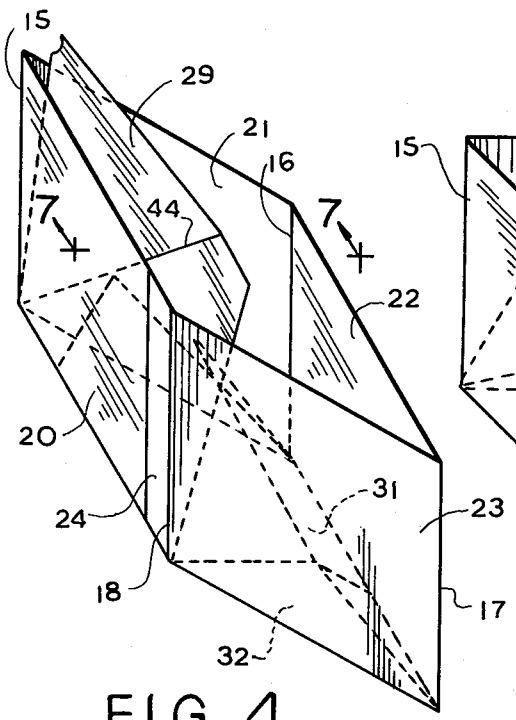
Figure 9:
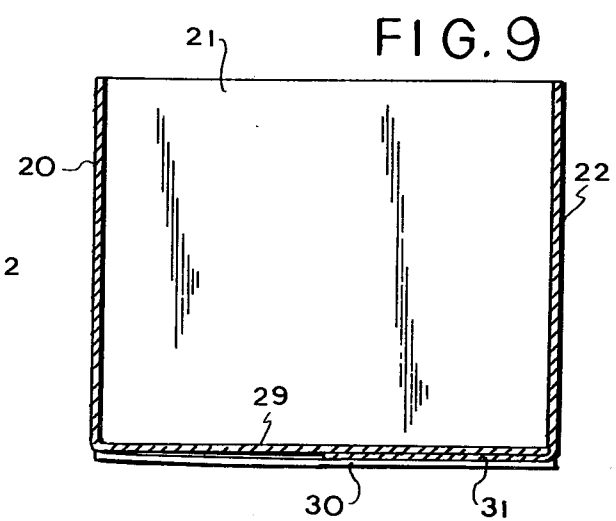
Figure 8:
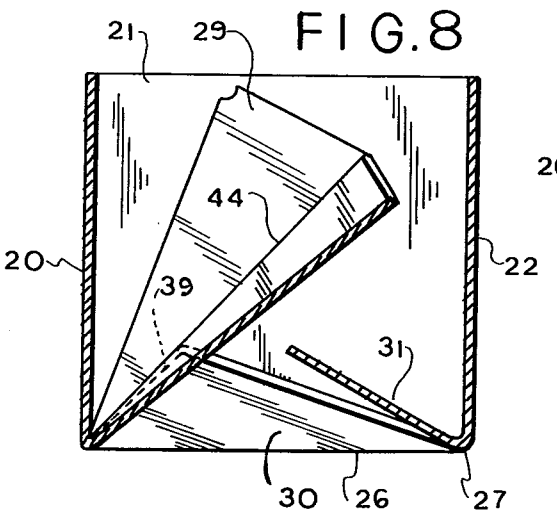
Figure 7:
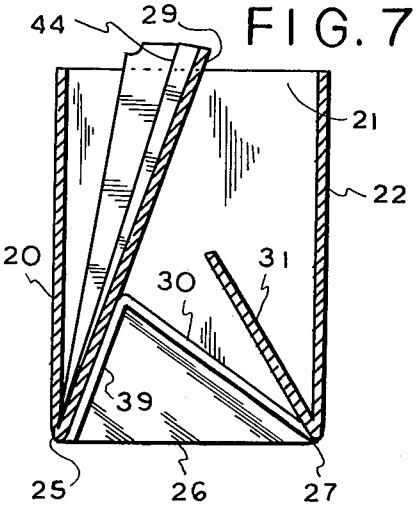

FIGS. 4, 5, and 6 are perspective views showing in sequence the unfolding or opening of the carton;

FIGS. 7, 8, and 9 are cross-sectional views taken along lines 7—7, 8—8, and 9—9, respectively, of FIGS. 4, 5, and 6, respectively.

Figure 10:
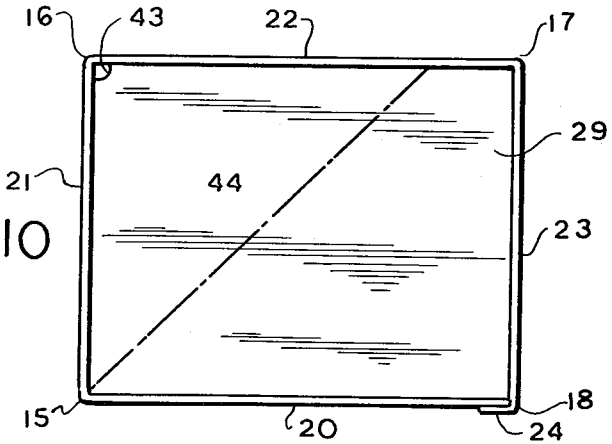

FIG. 10 is a top view of the carton in erect condition; and

Figure 11:
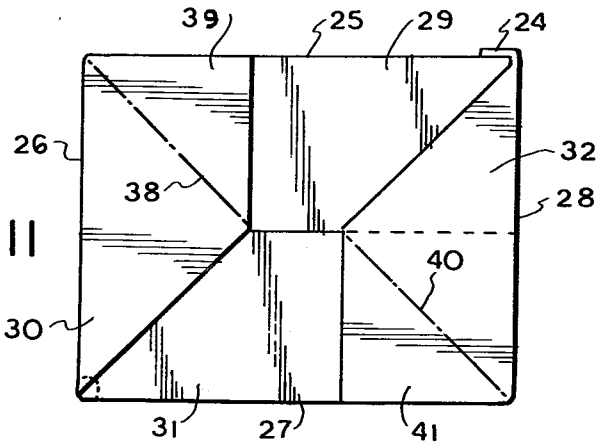

FIG. 11 is a bottom view of the carton in erect condition.

Figure 1:
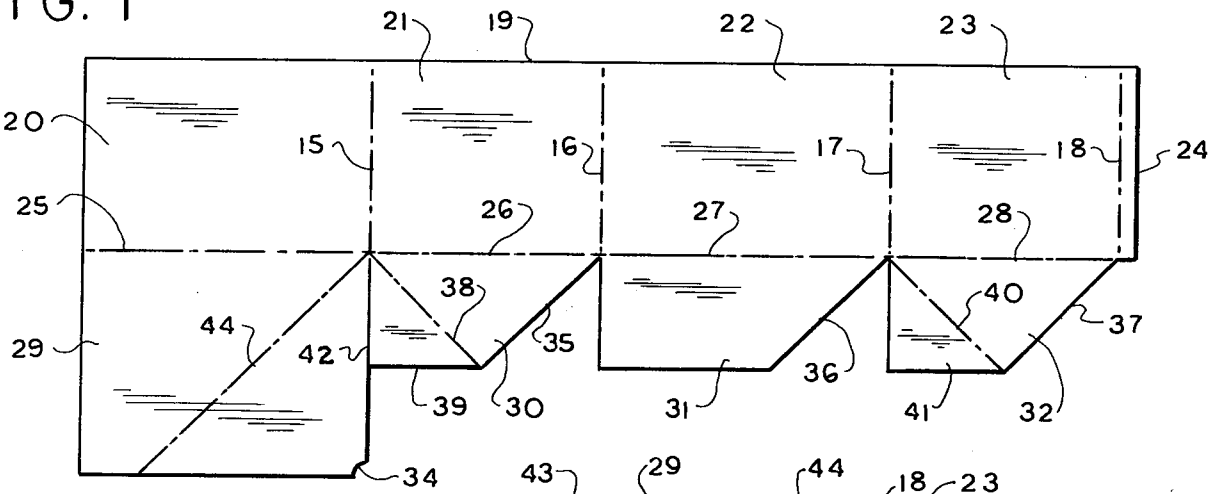
FIG. 1 is a pattern view of a blank of which a carton according to the invention may be formed.

The carton shown in FIGS. 2–11 may be formed from a one-piece corrugated cardboard blank shown in FIG. 1. The blank is provided with four parallel score lines 15, 16, 17, and 18, extending from and perpendicular to a long straight edge 19 of the blank, dividing the blank into two rectangular carton side walls 20 and 22, two rectangular carton end walls 21 and 23, and a glue flap 24. The blank is also provided with four aligned score lines 25, 26, 27, and 28 along which bottom panels 29, 30, 31, and 32 are, respectively, hinged to carton walls 20, 21, 22, and 23.

Bottom panels 30, 31, and 32 are of trapezoidal shape, each having an angled cut edge 35, 36, and 37, respectively. Bottom panel 30 has an angled score line 38 along which a triangular glue flap 39 is hinged to the remainder of the panel. Similarly, bottom panel 32 has an angled score line 40 along which a triangular glue flap 41 is hinged to the remainder of that panel. Glue flap 39 of panel 30 is separated from bottom panel 29 by a slit 42.

Bottom panel 29, larger than the other bottom panels, is rectangular, except for a notch 43 at one corner. Preferably, the dimensions of panel 29 in its own plane are such that the panel is about equal in size to the horizontal cross-sectional dimensions of the erect carton. Bottom panel 29 has a score line 44 serving as a hinge along which the two portions of the panel on opposite sides of score line 44 can bend with respect to each other. Score line 44 extends at an acute angle to hinge line 25, between side wall 20 and bottom panel 29, and from the end of hinge line 25 adjacent to panel 30. Score line 44 permits panel 29 to bend in a manner in which it otherwise would not be able to bend, since the score line runs transverse to the longitudinal direction of the corrugations of the cardboard forming panel 29.

To form a carton from the blank of FIG. 1, the four bottom panels 29–32 are folded upwardly, along score lines 25–28, against the upper faces of their respective carton walls 20–23. Glue flaps 39 and 41 are then folded downwardly, along score lines 38 and 40, respectively, against the nowupper faces of their respective panels 30 and 32. Glue is applied to flaps 24, 39, and 41. The folded-together side wall 20 and bottom panel 29 are then folded, along score line 15, against the upper faces of end wall 21 and panel 30, at which point glue flap 39 is permanently adhered to bottom flap 29. Finally, the folded-together end wall 23 and bottom panel 32 are folded, along score line 17, against the upper faces of side wall 22 and panel 31, at which point glue flap 41 is permanently adhered to bottom flap 31. In addition, glue flap 24 now overlaps the margin of side wall 20 and is permanently adhered to the side wall.

Figure 2:
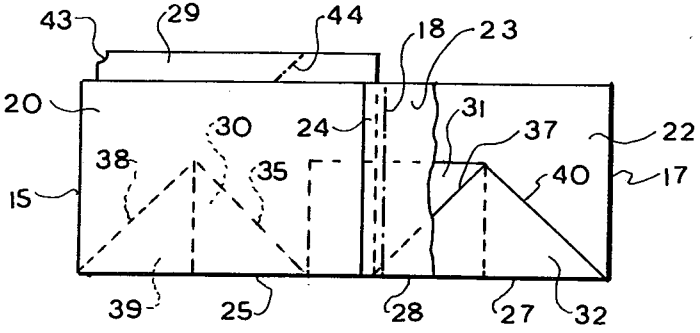
FIG. 2 is a side elevational view of the illustrative carton when in collapsed condition.
Figure 3:
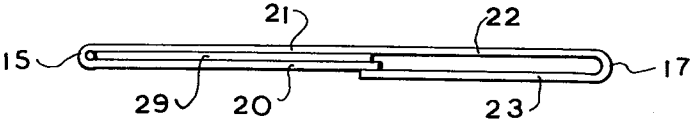
FIG. 3 is a top view of the collapsed carton.

The carton is now in its flattened or collapsed condition, illustrated in FIGS. 2 and 3. In this condition, aligned side wall 20 and end wall 23 overlie aligned side wall 22 and end wall 21, with the four bottom panels 29–32 between them. The four walls 20–23 are hinged together along score lines 15–18 for movement between the collapsed condition of FIGS. 2 and 3 and the erect condition of FIGS. 6 and 9–11. Bottom panels 31 and 32 are hinged together along score line 40, and bottom panels 29 and 30 are hinged together along score line 38. It will be seen (FIGS. 1 and 11) that the hinge line 38 between the hinged-together bottom panels 29 and 30 extends from the corner at which their respective side wall 20 and end wall 21 meet, and the hinge line 40 between the hinged-together bottom panels 31 and 32 extends from the corner at which their respective side wall 22 and end wall 23 meet. Furthermore, score line 44 of bottom panel 29 emanates from the same corner as score line 38, and a portion of score line 44 overlies and is parallel to score line 38.

To open or erect the carton, as illustrated in FIGS. 4–6 and in FIGS. 7–9, the aligned carton walls 20 and 23 are pulled away from aligned carton walls 21 and 22, thereby pivoting the walls about hinge lines 15–18 until each wall is perpendicular to the two walls adjacent to it. During this carton-erecting movement, hinged-together bottom panels 29 and 30 swing downwardly about hinge lines 25 and 26, respectively, and about their mutual hinge line 38. Similarly, hinged-together bottom panels 31 and 32 swing downwardly about hinge lines 27 and 28, respectively, and about their mutual hinge line 40. Thus, as the carton is opened, glue flaps 39 and 41 unfold, and in the erect condition of the carton these flaps are located in the same plane as the remainder of their panels 30 and 32, respectively.

When the carton is erected (FIGS. 6 and 9), the four bottom panels 29–32 are perpendicular to the four carton walls 20–23, thereby forming the floor of the carton. Panels 30 and 32 are the lowermost panels, and panel 31 extends across these two panels. Large panel 29 overlies and is supported by panels 30–32. Since panel 29 is equal in size to the horizontal cross-sectional dimensions of the carton, panel 29 covers the entire floor area of the carton, giving the carton a smooth unbroken floor. The carton bottom is extremely strong since panel 29 is supported on three sides by the panels 30–32, and on its fourth side by the hinge connection to its respective side wall 20.

As may be seen in FIGS. 4 and 5 and FIGS. 7 and 8, large bottom panel 29 bends along hinge line 44 as the carton is unfolded. If panel 29 did not bend in this way, the carton could not be unfolded, since panel 29 would be locked between carton walls 20 and 21. Hinge line 44 need not necessarily be located precisely as shown in the drawings, although one end should terminate at or near the point where hinge lines 25, 26, and 15 meet, as long as it permits bending of panel 29 in a way which frees it to swing downwardly when the carton is being erected. Notch 43 provides an opening into which a finger can be inserted for lifting panel 29 when the carton is to be collapsed. During collapsing movement, panel 29 bends along hinge line 44 to permit carton walls 20 and 21 to swing toward each other about hinge line 15.

An important advantage of the carton of this invention is that the die cutting and scoring of the corrugated board, to form the blank of FIG. 1, and the folding and gluing of the blank, to form the carton of FIGS. 2–11, can all be accomplished by machine, without the need for any hand operation.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. A foldable carton comprising side walls and end walls hingedly connected together along their side edges, a bottom panel hingedly connected to the lower edge of each wall, the bottom panels of two adjacent side and end walls being hingedly connected together and the bottom panels of the other two adjacent side and end walls being hingedly connected together, the bottom panels being folded between the side and end walls when the carton is in its collapsed condition and the bottom panels swinging downwardly to a position perpendicular to the side and end walls when the carton is erected, one of the bottom panels being larger than the others, the larger bottom panel overlying and being supported by all the other bottom panels when the carton is in its erected condition, the larger bottom panel having a hinge line along which it can bend in a direction away from the bottom panel to which it is hinged during movement of the large bottom panel when the carton is folded and unfolded between its collapsed and erect conditions, the hinge line extending at an acute angle to the hinge between the larger bottom panel and its respective carton wall, and the larger bottom panel being in flat unfolded condition when the carton is in its collapsed condition.

2. A foldable carton as defined in claim 1 wherein the dimensions of the larger bottom panel in its own plane are about equal to the horizontal cross-sectional dimensions of the carton.

3. A foldable carton as defined in claim 1 wherein the hinge between each pair of bottom panels extends from the corner at which their respective side and end walls meet.

4. A foldable carton as defined in claim 1 wherein one panel of each pair of hinged-together bottom panels has a hinged flap, the flap being permanently secured to a surface of the other bottom panel of the pair.

5. A foldable carton as defined in claim 4 wherein the flap is unfolded only when the carton is erect.

6. A foldable carton as defined in claim 1 wherein the hinge line of the larger bottom panel extends from the corner at which its respective carton wall meets the carton wall carrying the bottom panel to which the larger bottom panel is hingedly connected.

7. A foldable carton as defined in claim 6 wherein the hinge line extends to an edge of the larger bottom panel which does not meet the corner from which the hinge line emanates.

8. A foldable carton as defined in claim 1 wherein the hinge line of the larger bottom panel is parallel to the hinge between the larger bottom panel and the bottom panel to which it is hingedly connected.

9. A foldable carton as defined in claim 1 wherein the hinged line of the larger bottom panel overlies the entire length of the hinge between the larger bottom panel and the bottom panel to which it is hingedly connected.

* * * * *